US005624333A

United States Patent [19]

Dayton

[11] Patent Number: 5,624,333

[45] Date of Patent: Apr. 29, 1997

[54] GOLF TEE PLACEMENT DEVICE

[76] Inventor: Michael T. Dayton, P.O. Box 316, Mattawan, Mich. 49071

[21] Appl. No.: 641,945

[22] Filed: May 2, 1996

[51] Int. Cl.[6] ..... A63B 57/00

[52] U.S. Cl. ..... 473/386

[58] Field of Search ..... 473/386, 132, 473/284, 286, 408; 294/19.1, 19.2

[56] References Cited

U.S. PATENT DOCUMENTS

| | | | |
|---|---|---|---|
| 2,609,198 | 9/1952 | Armstrong | 473/386 |
| 3,889,946 | 6/1975 | Setecka | 473/386 |
| 3,904,200 | 9/1975 | Jackle et al. | 473/386 |
| 4,526,369 | 7/1985 | Phelps | 473/386 |
| 4,589,661 | 5/1986 | Attig | 473/386 |
| 4,616,826 | 10/1986 | Trefts | 473/386 |
| 4,714,250 | 12/1987 | Henthorn | 473/386 |
| 4,819,938 | 4/1989 | Hill | 473/386 |
| 4,949,961 | 8/1990 | Milano | 473/386 |
| 4,951,947 | 8/1990 | Kopfle | 473/386 |
| 4,969,646 | 11/1990 | Tobias | 473/386 |
| 5,171,010 | 12/1992 | Lanoue | 473/386 |
| 5,205,598 | 4/1993 | Miller | 473/386 |
| 5,306,000 | 4/1994 | Comella | 473/386 |
| 5,310,177 | 5/1994 | Conrad et al. | 473/386 |
| 5,330,178 | 7/1994 | Geishert, Sr. | 473/386 |
| 5,439,213 | 8/1995 | Pimentel | 473/386 |

*Primary Examiner*—Steven B. Wong

*Attorney, Agent, or Firm*—Flynn, Thiel, Boutell & Tanis, P.C.

[57] ABSTRACT

A golf ball/tee placement device including a vertically elongate support rod having a manually-engageable grip part fixed adjacent an upper end thereof. A tee support member is fixed to and projects sidewardly from the support rod adjacent a lower end thereof. The tee support member has a tee receiving slot extending vertically therethrough and opening sidewardly through a side edge thereof. A ball positioning member is mounted on the support rod closely adjacent but spaced vertically upwardly from the tee support member. The ball positioning member is rotatable relative to the rod about a longitudinal axis thereof. A ground-engaging member is mounted on the ball positioning member for engaging the ground to maintain the ball positioning member stationary while permitting the support rod and the tee support member to be rotated generally about the longitudinal axis. A ball/tee combination can be supported between the ball positioning and tee support members and the tee inserted into the ground, after which the support rod and tee support member are horizontally rotated about the longitudinal axis while the ball positioning member remains stationarily engaged with the ball, following which the placement device is lifted upwardly to disengage the ball.

20 Claims, 5 Drawing Sheets

FIG. 2
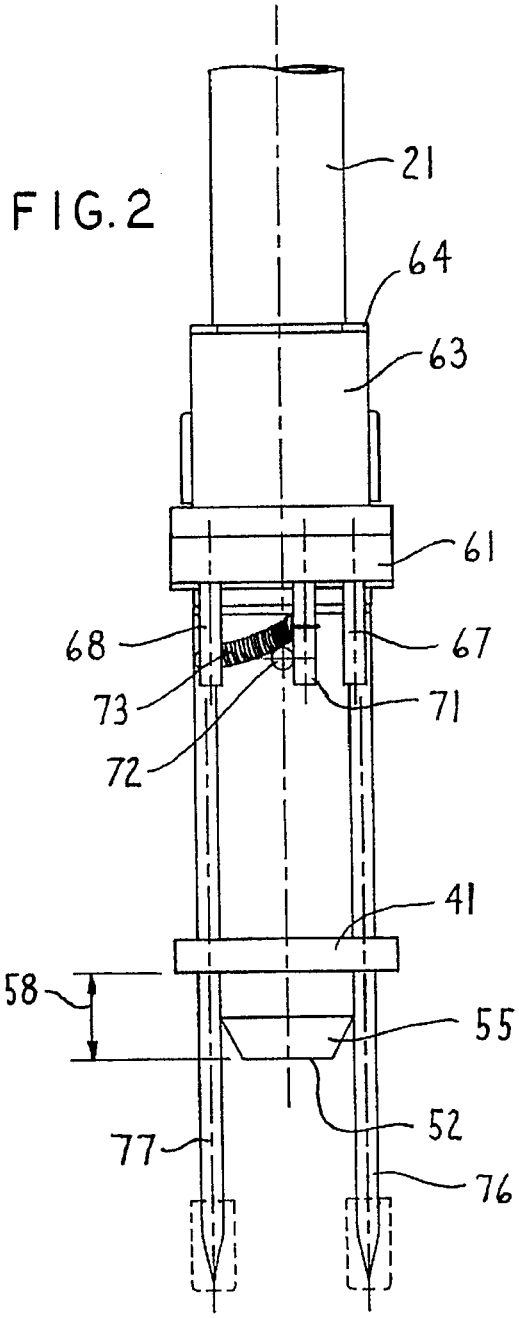
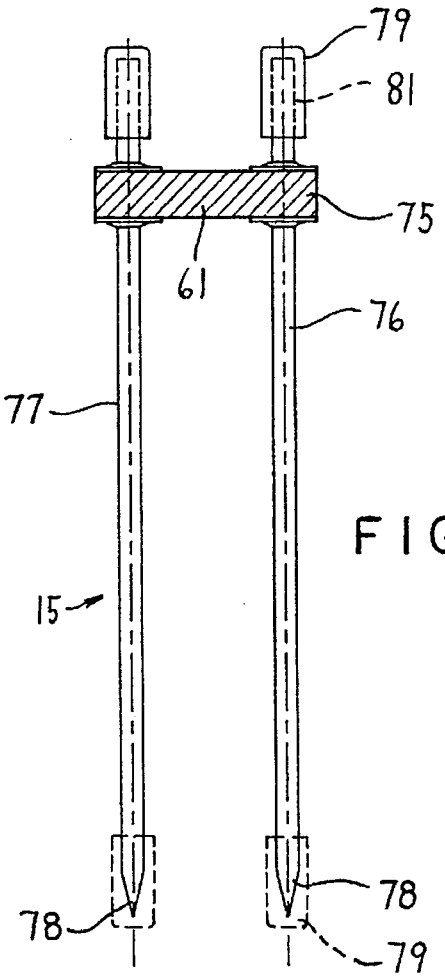
FIG. 3

GOLF TEE PLACEMENT DEVICE

FIELD OF THE INVENTION

This invention relates to a device for use in playing golf and, more particularly, to an improved ball/tee placement device.

BACKGROUND OF THE INVENTION

Numerous ball/tee placement devices have been developed to assist golfers in inserting a tee into the ground, with the ball already repositioned on the tee, without requiring the golfer to stoop or bend over. Such devices have traditionally employed some type of vertically elongate rod or pole having a gripping device at a lower end for supporting the ball/tee combination, and a trigger or release device movably mounted adjacent an upper end of the pole for releasing the gripping device. These arrangements have typically required the golfer to utilize both hands in engagement with the device, such as one hand supporting the pole and the other activating the trigger or release device, to permit proper manipulation of the device, particularly release of the device from the ball/tee combination after the tee has been properly inserted into the ground. These known devices which require both hands to effect proper manipulation thereof have hence detracted from the use such devices. For example, these two-handed devices typically require the golfer to initially insert the ball/tee combination into the ground and then release the device therefrom, whereupon the golfer returns the device to the bag or cart for storage, then picks up the appropriate club and returns to the tee area to effect striking of the ball. Many of these devices have not provided any capability for picking up either the tee or the ball and, even it they do, the golfer must first return to the cart so as to again retrieve the device from its storage position. These known devices have greatly increased the overall complications associated with their use, particularly due to the two-hand manipulation required thereby.

Examples of known ball/tee placement devices are shown by the following U.S. Pat. Nos.: 2,609,198, 3,889,946, 3,904,200, 4,526,369, 4,589,661, 4,616,826, 4,714,250, 4,819,938, 4,949,961, 4,951,947, 4,969,646, 5,171,010, 5,205,598, 5,306,000, 5,310,177, 5,330,178 and 5,439,213.

It is an object of this invention to provide an improved ball/tee placement device for use in playing golf, which placement device overcomes many of the disadvantages associated with prior known devices.

More specifically, this invention relates to an improved ball/tee placement device for playing golf wherein the device can be utilized for inserting the ball/tee combination into the ground while being manipulated with one hand, including removal of the device from the ball/tee combination after the latter has been inserted into the ground, without requiring the golfer to stoop or bend over.

The improved ball/tee placement device of this invention, as aforesaid, can also be positioned in a generally upright self-supporting position when not being supported by the golfer, such device being positioned close to the golfer so as to be readily accessible when not in use, whereupon the golfer can simultaneously support a club in one hand and the placement device in the other hand when moving into position to place the ball/tee combination, with the golfer then positioning the device slightly to one side out of the golfer's way, with the golfer still being generally in position to engage the club and effect striking of the ball. The device, in the preferred embodiment, employs ground-penetrating spikes which enable it to be self-supported in an upright position when not being manually supported and manipulated by the golfer.

The ball/tee placement device of the present invention, as aforesaid, further permits the golfer to pick up or remove the tee from the ground after striking the ball, without bending over, merely by utilizing the tee engaging part of the device for this purpose. In a preferred embodiment, the upper end of the device is also preferably provided with a ball-engaging gripping cup so that by vertically inverting the device the upper end can be utilized for engaging and picking up a ball without requiring bending by the golfer.

The improved ball/tee placement device, as aforesaid, also preferably provides an interior storage compartment within the elongate rod to permit storage of a plurality of tees therein, which tees are readily accessible by the golfer when needed.

The device of this invention, as aforesaid, is of a simple and compact structure, is simple and efficient to use, and is simple to store or carry in or on a golf bag.

Other objects and purposes of the invention will be apparent to persons familiar with devices of this general type upon reading the following specification and inspecting the accompanying drawings.

BRIEF DESCRIPTION OF THE DRAWINGS

FIGS. 2, 3, 4 and 5 are views taken generally along lines 2—2, 3—3, 4—4, and 5—5, respectively, in FIG. 1.

Figure 1:
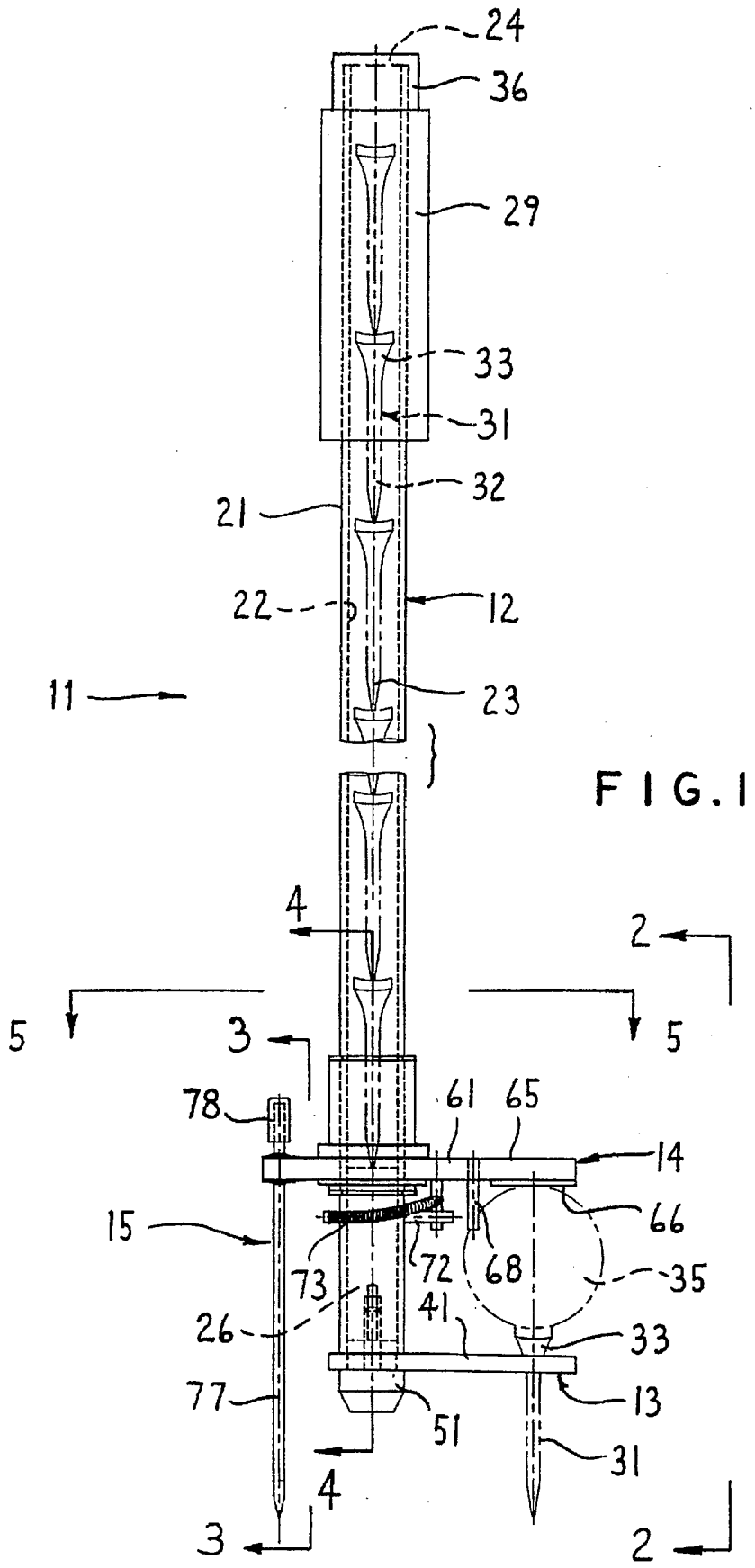
FIG. 1 is a side elevational view of the ball/tee placement device according to the present invention.

Certain terminology will be used in the following description for convenience in reference only, and will not be limiting For example, the words "upwardly" "downwardly", "rightwardly" and "leftwardly" will refer to directions in the drawings to which reference is made. The words "upper" and "lower" will also refer generally to the respective top and bottom ends of the device when in the normal position of use as illustrated by FIG. 1. The words "inwardly" and "outwardly" will refer to directions toward and away from, respectively, the geometric center of the device and designated parts thereof. Said terminology will include the words specifically mentioned, derivatives thereof, and words of similar import.

DETAILED DESCRIPTION

Referring to the drawings and specifically FIGS. 1–5, there is illustrated an improved golf ball/tee placement device 11 of the present invention. This device includes a vertically elongate support 12 having a tee support 13 fixed thereto adjacent the lower end thereof. A ball holding arrangement 14 is movably (that is, pivotally) mounted on the vertical support 12 in adjacent but upwardly-spaced relation from the tee support 13. The ball holding arrangement 14 mounts thereon a ground-engaging structure 15.

Considering the specifics of the vertically elongate support 12, it is defined generally by a vertically elongate hollow rod or tube 21, preferably a cylindrical hollow tube, having a generally cylindrical central bore 22 extending throughout the length thereof, whereby the support tube 21 has a generally longitudinally extending central axis 23. The upper end of tube 21 defines a top opening 24 which accesses the central bore 22.

The lower end of the central bore 22 is closed by a plug or rod 26 (FIG. 4) which is fixedly positioned within the tube 21 adjacent the lower end thereof. This plug or rod 26 defines thereon an upper surface 27, and also defines therein a threaded bore 28 which opens coaxially upwardly from the lower end thereof.

The vertically elongate support 12 also includes a gripping sleeve 29 which is fixed to and in surrounding relationship to the elongate tube 21 adjacent the upper end thereof. This gripping sleeve 29 is preferably constructed of an elastomeric or rubberlike material, and may have a somewhat roughened or textured outer surface, to facilitate manual engagement with the hand of the golfer.

The vertically elongate central bore 22 of the tube 21 is used to permit storage of a plurality of conventional golf tees 31 therein. The golf tee includes a lower pointed end part 32 which joins to an enlarged head part 33, the latter having a concave top surface for engagement with a golf ball, such as the ball 35 as indicated in dotted lines. The tees 31 are of generally conventional configuration, which configuration typically resembles that illustrated in FIG. 1 but which may assume other variations. The tees 31 can be stored within the central bore 22 by being vertically stacked generally on top of one another, with the lowermost tee having the lower pointed end thereof engaged with the top surface 27 of the plug 26. The tees can be readily accessed or removed by slightly tilting the tube 21 into a horizontal or slightly downwardly angled position so as to permit the uppermost tee to slide outwardly through the top opening 24 into the hand of the golfer. Tees can be easily reinserted back into the bore 22 merely by individually and sequentially inserting them through the top opening 24 so that they stack within the bore 22 substantially as illustrated by dotted lines in FIG. 1. The top opening 24 is normally closed by a removable cup-shaped cap 36 which snugly slides over the upper end of the rod 21.

Figure 6:
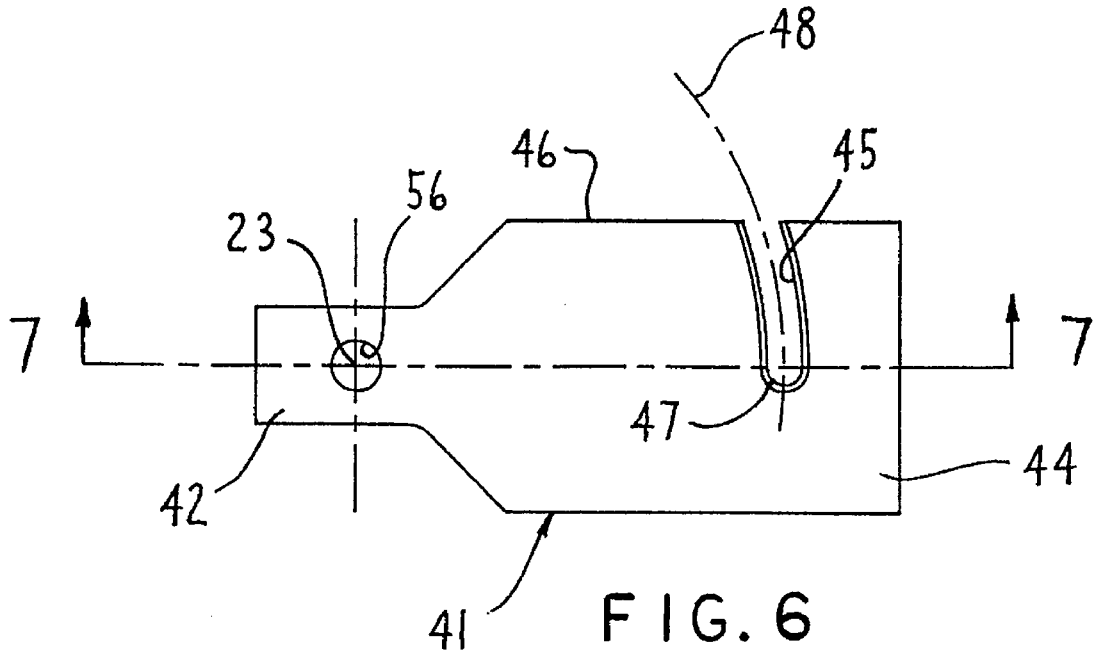
FIG. 6 is a top plan view of the tee support plate, the latter being shown separated from the remainder of the device for purposes of illustration.
Figure 8:
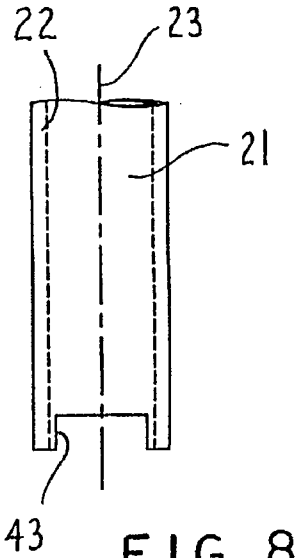
FIG. 8 is a fragmentary elevational view showing the bottom of the support tube.

The tee support 13 is formed primarily by a generally flat but horizontally enlarged support plate 41 which, as illustrated by FIG. 6, has a mounting part 42 of reduced width provided at one end thereof, which mounting part is accommodated within a notch or cutout 43 (FIG. 8) formed in the lower free end of the elongate tube 21, to nonrotatably secure the support plate 41 relative to the tube 21.

Figure 7:
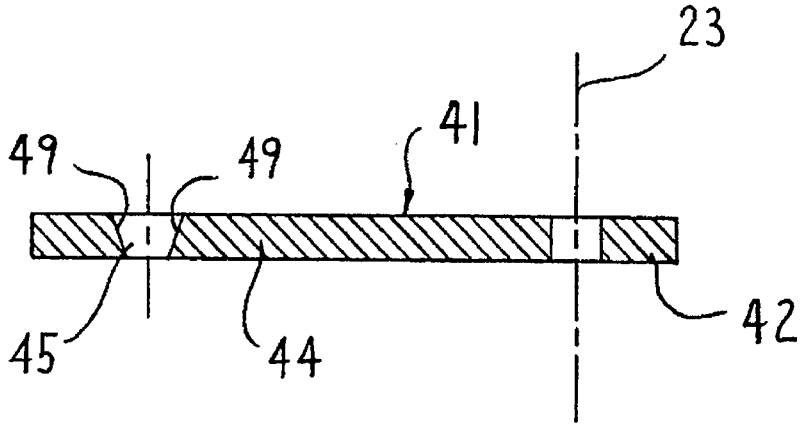
FIG. 7 is a sectional view taken generally along line 7—7 in FIG. 6.

The support plate 41 projects generally within a plane which extends transversely, more specifically perpendicularly, outwardly from the longitudinal axis 23, and includes a front plate part 44 defining therein an arcuate slot 45 which is spaced outwardly from the tube 21. The arcuate slot 45 opens inwardly from one side edge 46 of the plate 41, and terminates at a closed end 47 which is located generally in the middle of the plate as defined between the opposite side edges thereof. The slot 45 has a centerline 48 which is generated on a radius having its center disposed substantially on the longitudinal axis 23. The slot 45 is defined by opposed side walls 49 which, as illustrated by FIG. 7, are each slightly inclined relative to the vertical, with these opposed side walls 49 slightly converging with respect to one another as they project downwardly between the upper and lower surfaces of the plate 41, whereby the cross section of the slot has a generally downwardly tapering cross section.

The lower end of the tube 21 mounts thereon a removable stop 51, the latter also functioning to fixedly secure the tee support plate 41 to the rod 21. The stop 51 includes a generally cylindrical body 55 which is defined between a bottom surface 52 which is adapted to be positioned on the ground, and a top surface or shoulder 53 which is adapted to abut the underside of the mounting part 42 of the tee support plate 41. The stop has a threaded shank 54 which projects coaxially upwardly from the body 55 through a small clearance opening 56 formed in the tee mounting plate 41, with this threaded shank 51 being threadably engaged within the threaded bore 28 formed in the plug 26 so as to fixedly and stationarily attach the stop 51, tee support plate 41 and tube 21 together.

The height of the stop body 55 as measured between the bottom surface 52 and top surface 53, which height is designated 58 in FIG. 2, determines the height of the tee and hence the desired height of the ball relative to the ground. Accordingly, to permit the golfer to select a height which is most suitable, the device 11 preferably includes a plurality of interchangeable stops 51, each having a different height 58, whereby the golfer can select the desired height which is most convenient to his/her style of play merely by selectively interchanging the stops 51.

Considering now the ball holding arrangement 14, same includes a ball positioning member 61 formed from a thin but enlarged flat plate having a generally elongate rectangular shape. This member 61, intermediate the ends thereof, has an opening 62 therethrough which is sized so that the plate is fixedly positioned in supporting engagement with an axially elongate bushing sleeve 63. Positioning member 61 is held tight against a bottom face of a flange 88 of the bushing sleeve 63 by a retaining ring 89. This bushing sleeve 63 in turn is rotatably and externally supported on the support tube 21 adjacent the lower end thereof, with the bushing sleeve 63 being axially restrained adjacent opposite ends by securing rings 64 which fit within undercut annular grooves formed in the tube 21. The rotatable support of the bushing sleeve 63 on the rod 21, and the seating of the ball positioning plate 61 on the bushing sleeve 63, result in the ball positioning plate 61 projecting radially outwardly from the rod in generally perpendicular relation to the longitudinal axis 23. The plate 61 is disposed adjacent the lower end of the rod 21 but is vertically spaced upwardly a small distance above the tee support plate 41, with the vertical spacing between the plates 41 and 61 being substantially equal to (1) the diameter of the golf ball 35 plus (2) the height of the enlarged head part 33 of the tee, this relationship being illustrated by the dotted line showing of the ball and tee in FIG. 1. The plates 41 and 61 thus both project radially outwardly from the rod 21 in generally vertically spaced but parallel relationship, with the individual plates projecting horizontally when the rod 21 is vertically oriented.

The ball positioning plate 61 has a front plate part 65 which projects outwardly from the rod 21 and, adjacent the outer free end thereof, is provided with a ball-engaging pad 66 fixed to the undersurface thereof, which pad 66 faces downwardly toward the tee support plate 41. The pad 66 is preferably constructed of a thin resilient or elastomeric material, and is adapted to engage the upper surface of the ball 35 in the manner illustrated in FIG. 1.

The front plate part 65 also has a pair of pins 67 and 68 fixed thereto and projecting downwardly in cantilevered relation therefrom. These pins 67 and 68 are generally parallel and sidewardly spaced apart, and are positioned inwardly from the pad 66 toward the rod 21. The sidewardly spaced pins 67 and 68 are adapted to partially straddle the inner upper side of the golf ball 35 to assist in proper positioning thereof when the ball is engaged with the enlarged tee head 33 when the latter is supported on the tee support plate 41.

Figure 10:
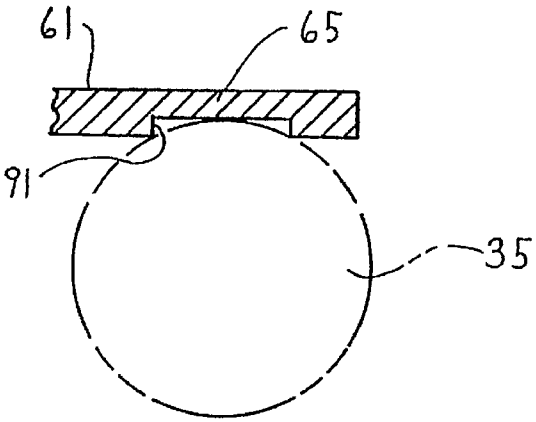
FIG. 10 is a fragmentary side elevational view showing a variation of the ball positioning member.

In a variation of the device, the pad 66 and pins 67 and 68 can be replaced by a countersunk hole or recess 91 (FIG. 10) opening upwardly from the bottom side of positioning plate 61 and into which the top of the ball 35 will be engaged, thereby properly positioning the ball when the ball is engaged with the enlarged tee head 33.

A stop pin 71 is fixed to and projects downwardly in cantilevered relation from the ball control plate 61, which stop pin 71 is disposed radially between the rod 21 and the ball positioning pins 67–68. Stop pin 71 is adapted to abut a further stop pin 72 which is fixed to the rod 21 and extends transversely thereacross and projects radially outwardly thereof for intersecting and contacting engagement with the stop pin 71. A spring 73, such as a conventional tension spring, is anchored between the rod 21 and the ball control plate 61 so as to rotatably urge the ball control plate 61 in a clockwise direction as viewed in FIG. 5 so as to continually urge the ball control plate in a direction whereby the stop pin 71 is normally maintained in engagement with the stop pin 72. In the illustrated embodiment, the spring 73 partially wraps around the rod 21 and has one end anchored to stop pin 71, and the other end anchored to a rearward end of stop pin 72. When the stop pins 71 and 72 are engaged with one another, the front plate part 65 is disposed substantially directly over and vertically aligned with the tee support plate 41 so that the ball/tee combination can be supportingly engaged therebetween substantially as indicated by dotted lines in FIG. 1.

The ball control plate 61 also includes a rear plate part 75 which projects radially outwardly from the rod 21 on substantially the diametrically opposite side from the front plate part 65. This rear plate part 75 mounts thereon the ground-engaging structure 15, the latter comprising a pair of parallel and vertically elongate pins 76 and 77 which are fixed to the rear plate part 75 in sidewardly spaced relation, and which project vertically downwardly therefrom in cantilevered relation. The pins 76–77 are intended to be engaged with the ground, and for this reason the pins 76–77 have a length such that they project downwardly so as to terminate at lower pointed free ends 78 which are disposed at an elevation a significant distance below the bottom surface 52 of the stop 51. The pointed lower ends 78 enable the pins 76–77 to be pushed downwardly and hence penetrate the ground in order to move the bottom surface 52 of the stop 51 into engagement with the surface of the ground.

A pair of removable cup-shaped caps 79 are also preferably provided, with one of the caps being manually and snugly slidably inserted over each pointed end 78 for protection purposes when the ball/tee placement device 11 is not being used. However, when the device 11 is in use, the caps 79 can be manually slidably removed from the pointed ends, and then slidably inserted over the upwardly-projecting cantilevered upper end parts 81 of the pins 76–77 for purposes of temporary storage.

Figure 9:
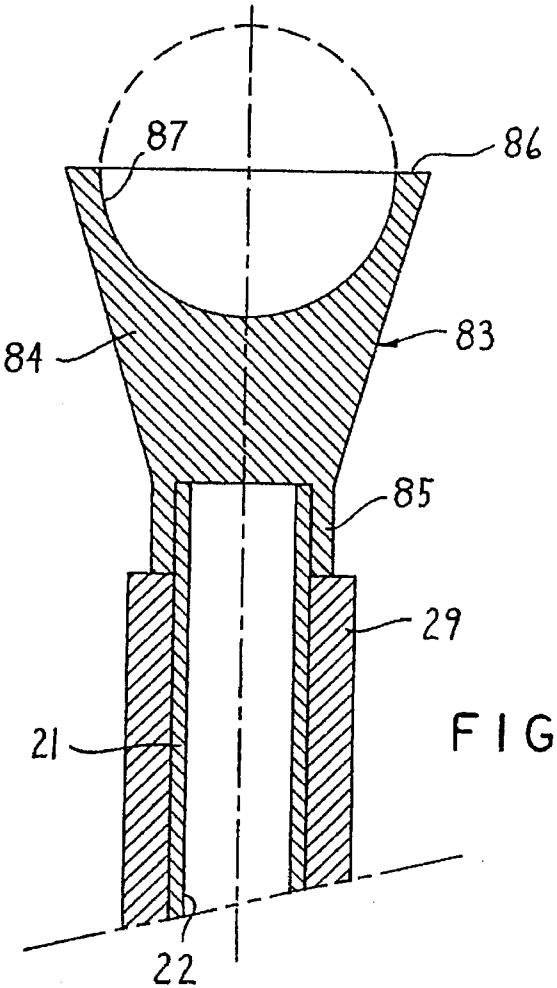
FIG. 9 is a fragmentary elevational view showing the top of the support pole and illustrating a modification of the invention.

As a possible and preferred modification of the ball/tee placement device 11 of the present invention, same can be provided with a ball retrieval arrangement 83 (FIG. 9) at the upper end of the rod 21. This ball retrieval arrangement 83 comprises a ball retrieval cup 84 which at the lower end thereof mounts a sleeve part 85 which is concentrically and coaxially slidably and removably mounted over the upper end of the tube 21. The cup 84 gradually tapers outwardly as it projects upwardly to the upper free end 86, whereby the latter has a diameter significantly greater than the lower end. The upper end 86 has a diameter greater than the diameter of a golf ball, and a generally semi-spherical ball-receiving recess 87 opens inwardly of the cup member. The cup member 84 is typically of an elastomeric or plastics material such that when the cup is moved downwardly into engagement with a ball laying on the ground, the ball will effectively become engaged within the recess 87 similar to a suction cup, whereupon the inverted device 11 can thus be used for picking up a golf ball from the ground without requiring the golfer to bend over.

When the device 11 is provided with the ball retrieval member 83, then the cap 36 is not utilized.

The ball retrieval cup 84 is a commercially available element, and one embodiment of same is sold by Dennco, Inc. under the brand name "Ball Pick-Up-Model 388".

The operation of the ball/tee placement device 11 will now be briefly described to ensure a complete understanding thereof.

When it is desired to use the placement device 11, a tee 31 is first slidably inserted into the open end of the slot 45 so that the enlarged head part 33 is disposed above the plate 41, and the tee is then slidably moved along the slot until it effectively abuts the closed end of the slot. The tee support plate 41 thus maintains the tee properly positioned, and the golfer then manually moves the golf ball 35 into position between the plates 41 and 61 so that the ball is seated on the upper surface of the tee head part 33, with the upper periphery of ball being engaged with and held in position by the resilient pad 66 or within the recess 91. In the variation of FIG. 1, the initial positioning of the ball is further assisted by the pair of pins 67–68 which prevent the ball from being moved inwardly too far.

With the placement device 11 maintained in a generally vertical orientation, the golfer then lowers the device downwardly to a position directly above the ground where the ball/tee combination is to be placed. The golfer then pushes downwardly on the device 11, such as by gripping the grip sleeve 29 with one hand and pushing downwardly, thereby causing the ground-engaging pins 76–77 to penetrate downwardly into the ground until the bottom surface 52 of the stop 51 contacts the ground. This thus indicates that the tee and specifically the ball is at the golfer's desired height.

Figure 5:
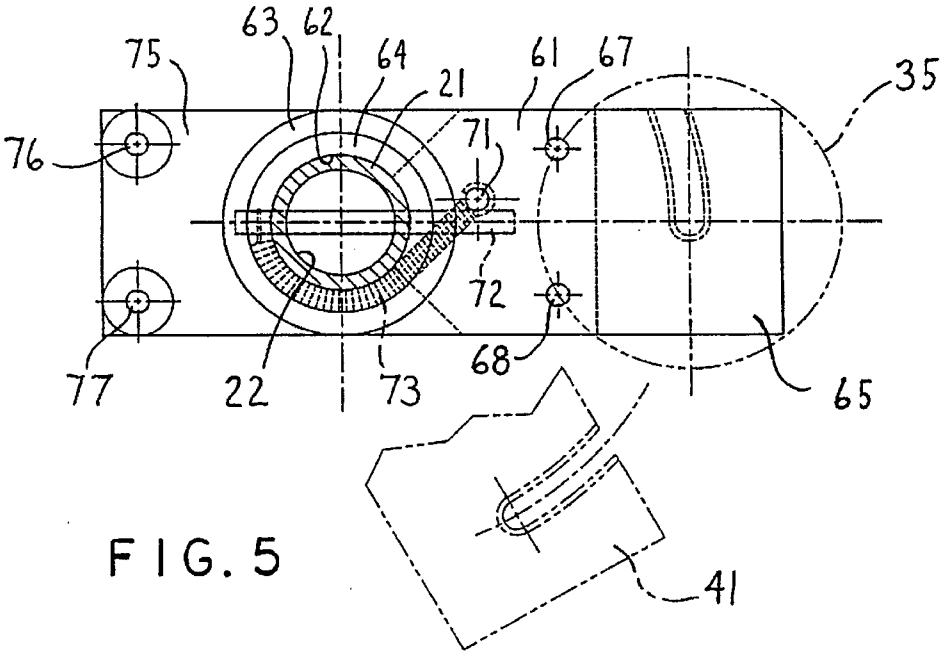
Figure 4:
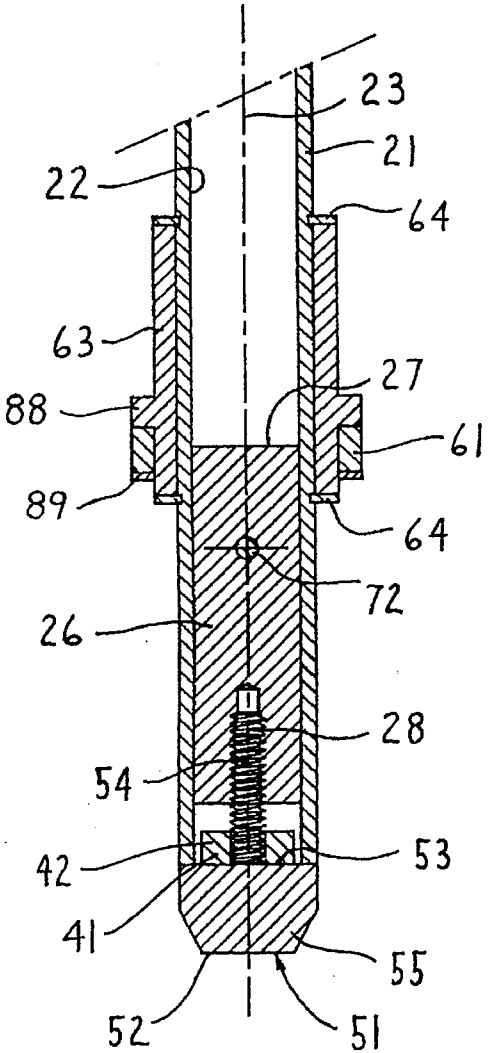

While still gripping the device 11 with one hand, such as one hand being engaged with the grip sleeve 29, the golfer then rotates the rod 21 horizontally about its longitudinal axis 23 through an angle of about 45°, thus causing the tee support plate 41 to also rotate horizontally sidewardly so as to disengage the tee and thus move into a position substantially as illustrated by dotted lines in FIG. 5. During this rotation of the rod 21 and tee support plate 41, however, the ball positioning plate 61 does not rotate, but rather remains stationary and thus rotates relative to the rod 21 due to the ground-engaging pins 76–77 being engaged with the ground. After the tee support plate 41 has been rotated into the release position shown by dotted lines in FIG. 5, however, and while still gripping the device with a single hand engaged with the gripping sleeve 29, the golfer can lift the entire device 29 upwardly, which initial lifting causes the ball positioning plate 61 to be moved upwardly out of engagement with the ball, even though the plate 61 remains horizontally stationary due to the lower ends of pins 76–77 being engaged with the ground. Additional upward lifting causes these pins 76–77 to disengage the ground, whereupon the spring 73 then rotatably urges the ball positioning plate 61 in a clockwise direction in FIG. 5 so that this plate then returns to its initial position where the pin 71 abuts the stop pin 72, whereupon the ball positioning plate 61 is again positioned generally in vertically aligned relationship over the tee support plate 41.

With the device 11 now totally disengaged from the ball/tee combination, and the latter being properly maintained in engagement with the ground, the golfer can position the device 11 is a storage position in close proximity merely by inserting the pins 76–77 downwardly into the ground, whereupon the device 11 will thus remain in an upright self-supporting position while the golfer proceeds with striking the ball.

While the operation as described above refers to manual upward lifting of the device 11 to effect disengagement of the ball positioning plate 61 from the ball, it will be appreciated that other slight variations in the movement of the device 11 can accomplish the same purpose. For example, after the tee support plate 41 has been moved into the open disengaged position shown by dotted lines in FIG. 5, the entire device 11, while still being gripped by one hand, can be tilted rearwardly a limited extent about the ground-penetrating pin 76–77, which rearward tilting is sufficient to swing the plate 61 upwardly out of engagement with the ball, whereupon the golfer then manually lifts the entire device 11 upwardly to disengage the pins from the ground, whereupon the device 11 then automatically restores itself to its original position, substantially as described above.

With the device 11 of the present invention, and as briefly described above, a golfer can easily set the ball/tee combination into the ground while holding, controlling and manipulating the device 11 with a single hand, whereupon the golfer hence has the other hand available for whatever purpose, such as to holding the golf club. Further, once the device has been utilized, it can be readily and conveniently stored in close proximity to the golfer in an upright position so that the golfer can easily retrieve it when desired without having to bend over.

It will be appreciated that the device 11 can also be provided with a hook fixed thereto, such as fixed to the rod 21 adjacent the upper end thereof, to permit the device 11 to be hung over the upper edge of a golf bag.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A golf ball/tee placement device, comprising:

a vertically elongate support rod having a manually-engageable grip part fixedly associated therewith adjacent an upper end thereof;

a tee support member fixed to and projecting sidewardly from said support rod adjacent a lower end thereof, said tee support member having a tee receiving slot extending vertically therethrough and opening sidewardly through one side edge thereof, said tee support member being adapted to support a golf tee thereon so that an enlarged head part of the tee is disposed thereabove with a pointed pinlike lower part of the tee projecting downwardly through the slot;

a ball positioning member mounted on said support rod at a position closely adjacent but spaced vertically upwardly from said tee support member, said ball positioning member being rotatable relative to said rod about a longitudinal axis thereof;

ground-engaging means mounted on said ball positioning member for engaging the ground to maintain the ball positioning member stationary while permitting the support rod and the tee support member fixed thereto to be rotated generally about the longitudinal axis;

whereby a ball/tee combination can be supported between the ball positioning and tee support members and the tee inserted into the ground, after which the support rod and tee support member can be horizontally rotated about the longitudinal axis while the ball positioning member remains stationarily engaged with the ball, following which the placement device is lifted upwardly to disengage the ball.

2. A device according to claim 1, including first and second stop pins fixed respectively to the ball positioning member and the support rod, and spring means normally rotatably urging the ball positioning member relative to the support rod to cause said first and second stop pins to be normally maintained in engagement with one another, said ball positioning member being positioned generally vertically aligned with and generally directly over the tee support member when said first and second stop pins are engaged.

3. A device according to claim 2, wherein said ball positioning member has a ball-engaging structure positioned on an underside thereof in downwardly facing relationship toward the tee support member, whereby said structure engages an upper periphery of a golf ball when a tee and ball are engaged between the tee support member and the ball positioning member.

4. A device according to claim 3, wherein said ball-engaging structure comprises a thin resilient pad secured to the underside of said positioning member.

5. A device according to claim 3, wherein said ball-engaging structure comprises a recess formed in and opening upwardly from the underside of said positioning member.

6. A device according to claim 3, including a stop removably attached to the lower end of said support rod and defining a bottom surface thereon adapted for engagement with a surface of the ground, said stop functioning to define the height of the ball when the tee is inserted into the ground.

7. A device according to claim 6, including a plurality of said stops each being removably but replaceably attached to the lower end of said support rod, each said stop having a different height so as to adjust the height of the ball when supported on the tee which is inserted into the ground.

8. A device according to claim 7, wherein said ground-engaging means includes a vertically elongate cantilevered ground-penetrating element which is fixed to said ball positioning member and projects downwardly a significant extent beyond said rod and said tee support member for penetrating downwardly into the ground when the placement device is positioned for inserting the tee into the ground.

9. A device according to claim 1, wherein said tee support member comprises a generally flat and horizontally enlarged thin plate which is fixed to and projects radially outwardly from one side of said support rod directly adjacent a lower free end thereof, said slot opening inwardly from one side edge of said plate, said slot being arcuate and generated about a radius centered on said longitudinal axis.

10. A device according to claim 9, wherein said ball positioning member comprises a thin and horizontally enlarged flat plate which projects generally horizontally and radially outwardly from said support rod so that said ball positioning plate is disposed in generally parallel but vertically upwardly-spaced relation from said tee support plate.

11. A device according to claim 10, wherein said ball positioning member has a front plate part which is spaced radially outwardly from said rod and has a ball-engaging structure provided on an undersurface thereof and disposed in opposed and downwardly facing relationship to said tee support member.

12. A device according to claim 11, wherein said ball-engaging structure comprises a thin resilient pad secured to the underside of said positioning member.

13. A device according to claim 12, including a pair of generally sidewardly spaced and parallel pins fixed to and projecting downwardly in cantilevered relation from said ball positioning member, said pins being disposed adjacent one side of said pad and positioned generally radially between said pad and said rod to assist in positioning of the golf ball on the enlarged head of the tee when the ball is inserted between the plates.

14. A device according to claim 11, wherein said ball-engaging structure comprises a recess formed in and opening upwardly from the underside of said positioning member.

15. A device according to claim 11, wherein the plate defining said ball positioning member includes a rear plate part which projects radially outwardly from said rod, and said ground-engaging means including a pair of vertically elongate ground-penetrating pins fixed to and projecting downwardly in cantilevered relation from said rear plate part, said pins projecting downwardly and terminating in bottom free ends which are disposed at an elevation substantially below a lowermost end of said rod and said tee support plate.

16. A device according to claim 10, wherein said ground-engaging means includes a vertically elongate cantilevered ground-penetrating element which is fixed to said ball positioning member and projects downwardly a significant extent beyond said rod and said tee support member for penetrating downwardly into the ground when the placement device is positioned for inserting the tee into the ground.

17. A device according to claim 1, wherein said ground-engaging means includes a vertically elongate cantilevered ground-penetrating element which is fixed to said ball positioning member and projects downwardly a significant extent beyond said rod and said tee support member for penetrating downwardly into the ground when the placement device is positioned for inserting the tee into the ground.

18. A device according to claim 17, wherein the ground-engaging means includes a plurality of said ground-penetrating elements positioned in generally parallel but sidewardly spaced relation.

19. A device according to claim 1, including a stop removably attached to the lower end of said support rod and defining a bottom surface thereon adapted for engagement with a surface of the ground, said stop functioning to define the height of the ball when the tee is inserted into the ground.

20. A device according to claim 19, including a plurality of said stops each being removably but replaceably attached to the bottom of said support rod, each said stop having a different height so as to adjust the height of the ball when supported on the tee which is inserted into the ground.

* * * * *